US005331302A

United States Patent [19]

Yoshimura et al.

[11] Patent Number: 5,331,302

[45] Date of Patent: Jul. 19, 1994

[54] MINIATURE TRANSFER RELAY

[75] Inventors: Takashi Yoshimura, Obata; Takayasu Ishizuka, Obihiro; Masayui Shiomi, Tsu; Tomoyoshi Hayashi, Tsu; Hiroaki Aihoshi, Tsu; Hisanobu Tanaka, Hisai, all of Japan

[73] Assignee: Matsushita Electric Works, Ltd., Osaka, Japan

[21] Appl. No.: 47,482

[22] Filed: Apr. 19, 1993

[30] Foreign Application Priority Data

Aug. 26, 1992 [JP] Japan ..... 4-226648
Feb. 10, 1993 [JP] Japan ..... 5-022865

[51] Int. Cl.[5] ..... M01H 51/22

[52] U.S. Cl. ..... 335/78; 335/128; 335/83

[58] Field of Search ..... 335/78-86, 335/124, 128, 131

[56] References Cited

U.S. PATENT DOCUMENTS 4,542,582 9/1985 Tsunakawa ..... 335/83
4,933,654 6/1990 Hori et al. .

FOREIGN PATENT DOCUMENTS 0100165 2/1984 European Pat. Off. .

*Primary Examiner*—Lincoln Donovan
*Attorney, Agent, or Firm*—Stevens, Davis, Miller & Mosher

[57] ABSTRACT

A miniature transfer relay has a base mounting a contact assembly and an electromagnet. The contact assembly includes a normally-open (NO) fixed contact, a normally-closed (NC) fixed contact, a common conductor, and a movable spring extending from the common conductor and carrying first and second movable contacts engageable respectively with the NO and NC contacts. The electromagnet block includes an armature which is movable between set and reset positions and is connected to the movable spring for making and breaking the NO and NC contacts simultaneously in response to the armature movement. The NO fixed contact and the common conductor are molded in an upper surface of the base, while the NC fixed contacts has a portion molded in the base. The movable spring is an elongated self-biased resilient member which is formed at one longitudinal end thereof with the first movable contact and which is secured at the other longitudinal end to the common conductor such that the movable spring can resiliently flex in a cantilever fashion to move the first movable contact into and out of contact with the NO fixed contact. The relay is characterized in that the movable spring carries the second movable contact at a portion intermediate its longitudinal ends and on a surface opposite of the first movable contact, and that the NC fixed contact extends upwardly from the base and is bent over the movable spring to be kept in normally closed relation to the second movable contact.

11 Claims, 5 Drawing Sheets

MINIATURE TRANSFER RELAY

BACKGROUND OF THE INVENTION

1. Field of the Invention

The present invention is directed to a miniature transfer relay having normally-closed and normally-open contacts.

2. Description of the Prior Art

In a prior miniature transfer relay, it is common to mount a contact assembly on a relay base, for example, as disclosed in USP 4,933,654. The contact assembly includes a set of normally-open (NO) and normally-closed (NC) contacts, and associated contacts carried on a movable spring which are all disposed to project on the base. With this mounting structure, the relay is required to have an increased height for accommodating the contact assembly, which is a hindrance to miniaturization of the relay. In order to reduce the height dimension of the contact assembly, another prior transfer relay has been proposed to mold the NO and NC contacts in the surface of the base, while disposing only the movable spring to project on the base, for example, as disclosed in the European Patent Publication EP 0 100 165 B1. However, the transfer relay of this type requires the movable spring to have a rather complicated configuration having first and second movable contacts corresponding respectively to the NO and NC fixed contacts. In order to obtain transfer operation, the movable spring is made as an elongated member which is pivotally supported intermediate its longitudinal ends and is provided on the opposed longitudinal ends with the first and second movable contacts in correspondence to the NO and NC fixed contacts. It is this pivot structure that adds the complexity to the configuration of the movable spring and also requires the movable spring to have an increased length, which makes the prior art transfer relay still insufficient for achieving further miniaturization with a simple contact assembly structure.

SUMMARY OF THE INVENTION

The above problem and insufficiency have been eliminated in the present invention which provides an miniature transfer relay of an improved contact arrangement. The miniature transfer relay in accordance with the present invention comprises a molded base mounting a contact assembly and an electromagnet block. The contact assembly includes a normally-open (NO) fixed contact, a normally-closed (NC) fixed contact, a common conductor, and a movable spring extending from the common conductor and carrying first and second movable contacts in contacting relation respectively with the NO and NC fixed contacts. The electromagnet block is disposed on the base over the contact assembly and includes a coil and an armature which is movable between set and reset positions upon energization and deenergization of the coil. The armature is operatively connected to the movable spring so as to close and open the NO and NC contacts simultaneously in response to the armature movement between the set and reset positions. The NO fixed contact and the common conductor are molded in an upper surface of the base, while the NC fixed contacts has a portion molded in the base. The NO and NC fixed contact and the common conductor have a NO terminal lead, a NC terminal lead, and a common terminal lead, respectively projecting from the base. The movable spring is an elongated self-biased resilient member which is formed at one longitudinal end thereof with the first movable contact and which is secured at the other longitudinal end to the common conductor such that the movable spring can resiliently flex in a cantilever fashion to move the first movable contact into and out of contact with the NO fixed contact. The characterizing feature of the relay resides in that the movable spring carries the second movable contact at a portion intermediate its longitudinal ends and on a surface opposite of the first movable contact, and that the NC fixed contact extends upwardly from the base and is bent over the movable spring to be kept in normally closed relation to the second movable contact on the movable spring. With this structure, a movable spring of simple cantilever support is enough to effect transfer contacting operation with only the NC fixed contact projecting together with the movable spring on the base, while leaving the NO fixed contact molded in the upper surface of the base together with the common conductor associated with the movable spring. Accordingly, it is a primary object of the present invention to provide an improved miniature transfer relay which is capable of reducing the height dimension of the contact assembly, yet allowing the use of a movable spring having a simple structure.

Preferably, the NO fixed contact, NC fixed contact, and the common conductor are punched out together with the associated terminal leads from a single metal sheet so that the contact assembly, except the movable spring, can be formed commonly from the single metal sheet.

It is therefore another object of the present invention to provide an improved miniature transfer relay which is capable of simplifying the contact assembly.

In a preferred embodiment, the relay includes a pair of the additional contact assemblies, which are disposed in a side-by-side relation with the individual movable springs extending in parallel with each other on the base. A separator rib projects on the base between the movable springs of the two adjacent contact assemblies for effective insulation therebetween, which is therefore a further object of the present invention.

The separator rib may be formed in opposite side thereof with a pair of notches into which free ends of the NC fixed contacts of the two contact assemblies are fitted, respectively. Thus, the NC contacts which project on the base can be held exactly in place to assure reliable relay operation, which is a still further object of the present invention.

These and still other objects and advantageous features of the present invention will become more apparent from the following description of the preferred embodiment when taken in conjunction with the attached drawings.

DETAIL DESCRIPTION OF THE EMBODIMENT

Figure 1:
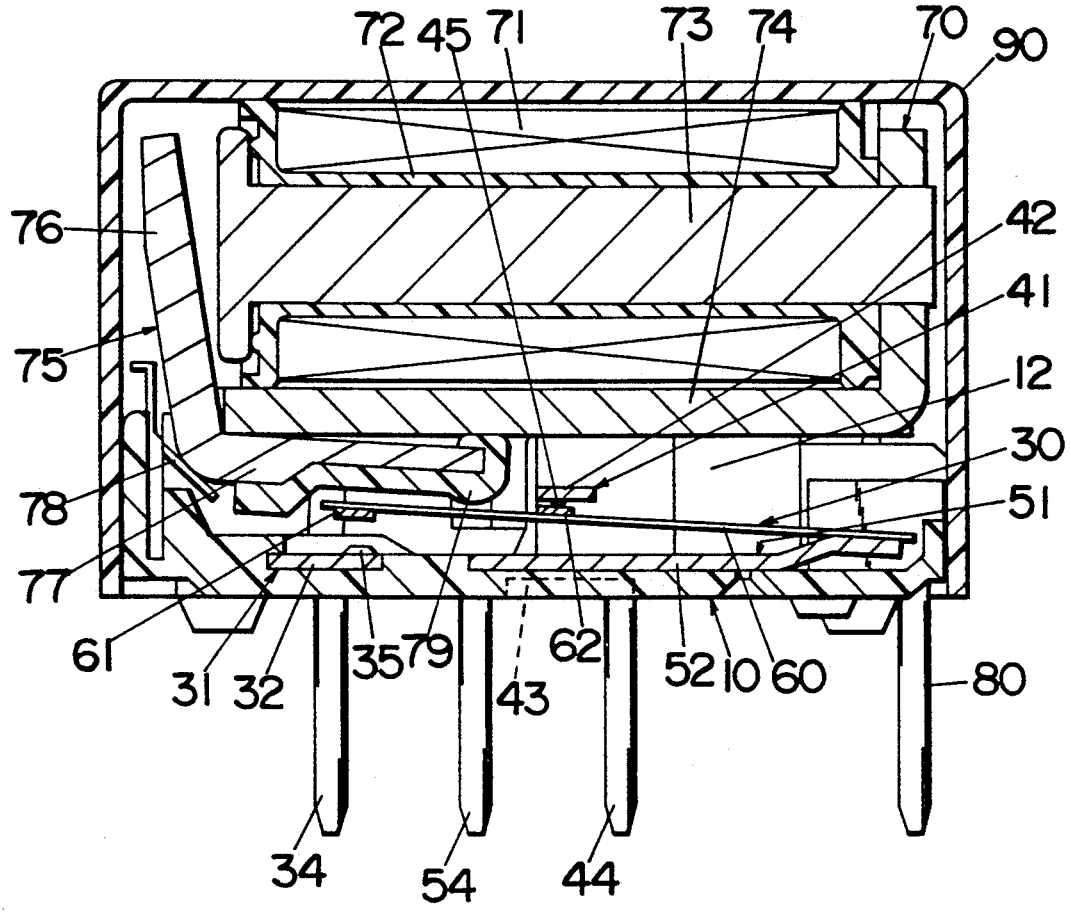
FIG. 1 is a vertical sectional view of a miniature transfer relay in accordance with a preferred embodiment of the present invention.
Figure 2:
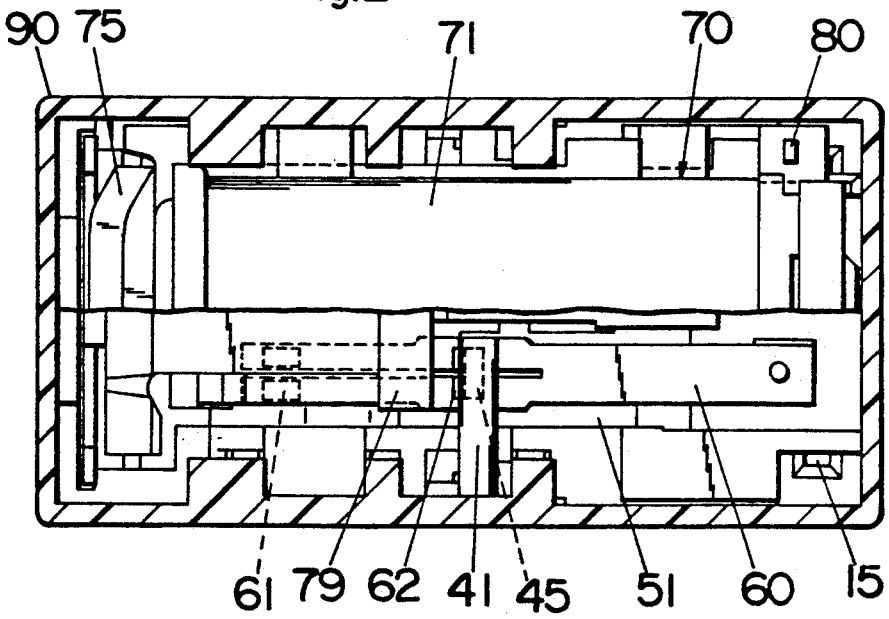
FIG. 2 is a top view partly in section of the above relay.

Referring now to FIGS. 1 to 5, there is shown a miniature transfer relay in accordance with a preferred embodiment of the present invention. The relay includes a molded base 10 of an electrically insulating plastic material for mounting thereon a pair of contact assemblies 30 and an electromagnetic block 70. The contact assembles 30 are disposed in side-by-side relation partly on the base 10. Each of the contact assemblies 30 comprises a normally-open (NO) fixed contact 31, a normally-closed (NC) contact 41, and a movable spring 60 carrying first and second contacts 61 and 62 which are engageable with the NO and NC contacts 31 and 41, respectively. The NO and NC contacts 31 and 41 are formed respectively with contact tips 35 and 45 and also formed with NO and NC terminal leads 34 and 44 extending outwardly from the base 10 for connection with an external circuit. Also included in the contact assembly 30 is a common conductor 51 which is connected to support the movable spring 60 and is provided with a common terminal lead 54 for connection with the external circuit. The movable spring 60 is an elongated resilient member which is secured at its one longitudinal end by welding to one end of the common conductor 51 so that it is movable between two contact operation positions of making and breaking the NO and NC contacts 31 and 41, simultaneously.

The electromagnet block 70 comprises an excitation coil 71 wound about a coil bobbin 72, a core 73 extending through the coil bobbin 72, and an L-shaped yoke 74 with a short leg connected to one end of the core 73 and a long leg extending in parallel with the core 73 outwardly of the coil 71. A pair of coil terminal leads 80 extends vertically through the end of the coil bobbin 72 with the upper ends of the leads 80 connected to the ends of the coil 71. Also included in the electromagnet block 70 is a generally L-shaped armature 75 which is pivotally connected to the end of the yoke 74 at an inside corner formed between vertical and horizontal members 76 and 77 of the armature 75 so that it is movable between set and reset positions in response to the energization and deenergization of the coil 72. That is, upon energization of the coil 71, the armature 75 pivots into the set position where the vertical member 76 is attracted to a pole end of the core 73, while, upon deenergization of the coil 71, the armature 75 pivots back to the reset position of moving the vertical member 76 away from the pole end by the action of a return spring 78 fitted in the end of the base 10 and engaged to the outside corner of the armature 75. The horizontal member 77 of the armature 75 is fitted with an actuator 79 of electrically insulating plastic which is engageable commonly with the movable springs 60 of the contact assemblies 30. Thus, each movable spring 60 is connected commonly to the armature 75 so as to make and break the NO and NC contacts 31 and 41 in response to the armature movement between set and reset positions. The electromagnet block 70 is disposed over the contact assemblies 30 and is supported on shoulders 11 in a peripheral wall of the base 10.

Figure 3:
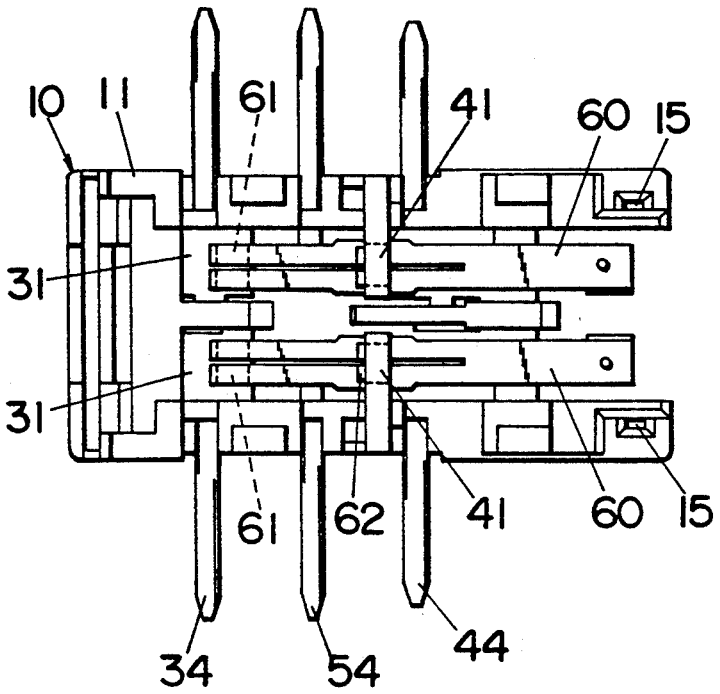
FIG. 3 is a top view illustrating a contact assembly mounted on a base of the above relay.
Figure 4:
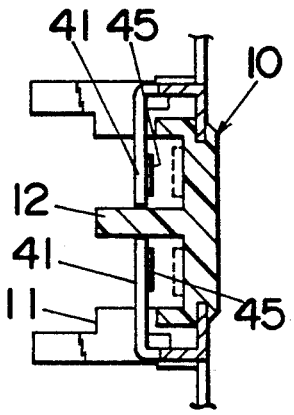
FIG. 4 is a side view of the contact assembly on the base.
Figure 5:
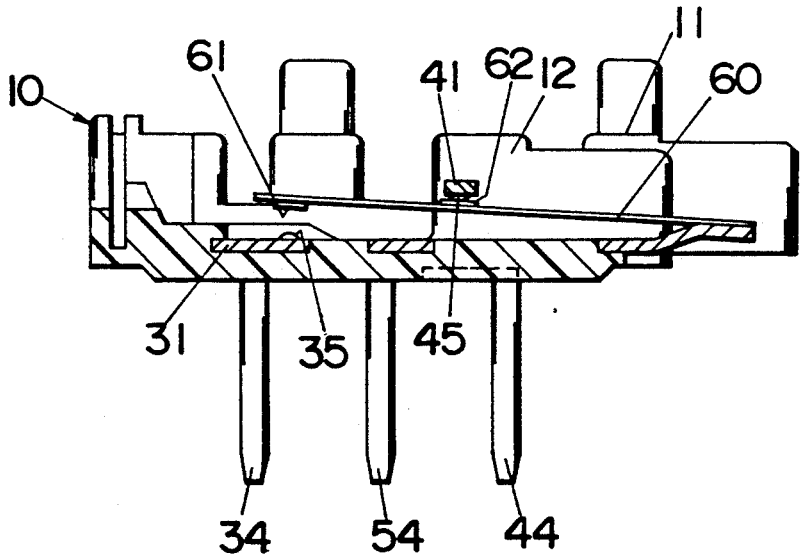
FIG. 5 is a front view partly in section of the contact assembly on the base.

As will be discussed later in detail, the NO contact 31 and common conductor 51 have their major portion molded in the upper surface of the base 10. The movable spring 60 is self-biased into the position of keeping the first contact 61 disengaged from the NO contact 31 and keeping the second contact 62 engaged with the NC contact 41, as shown in FIG. 1. As seen in the FIGURE, the first contact 61 is formed on the underside of the movable spring 60 at a free end thereof, while the second contact 62 is on the upper side of the movable spring 60 intermediate its ends. The NC contact 41 projects on the base 10 beyond the movable spring 60 to be engageable with the second contact 62 on the movable spring 60. It is noted here that the actuator 79 and the NC contact 41 are spaced along the length of the movable spring 60 so that they are well received in a limited height space between the electromagnet block 80 and the base 10. The base 10 is provided with a separator rib 12 which extends between the movable springs 60 of the two adjacent contact assemblies 30, as shown in FIGS. 3 to 5, to establish effective insulation therebetween, in addition to support thereon the electromagnet block 70.

Figure 6:
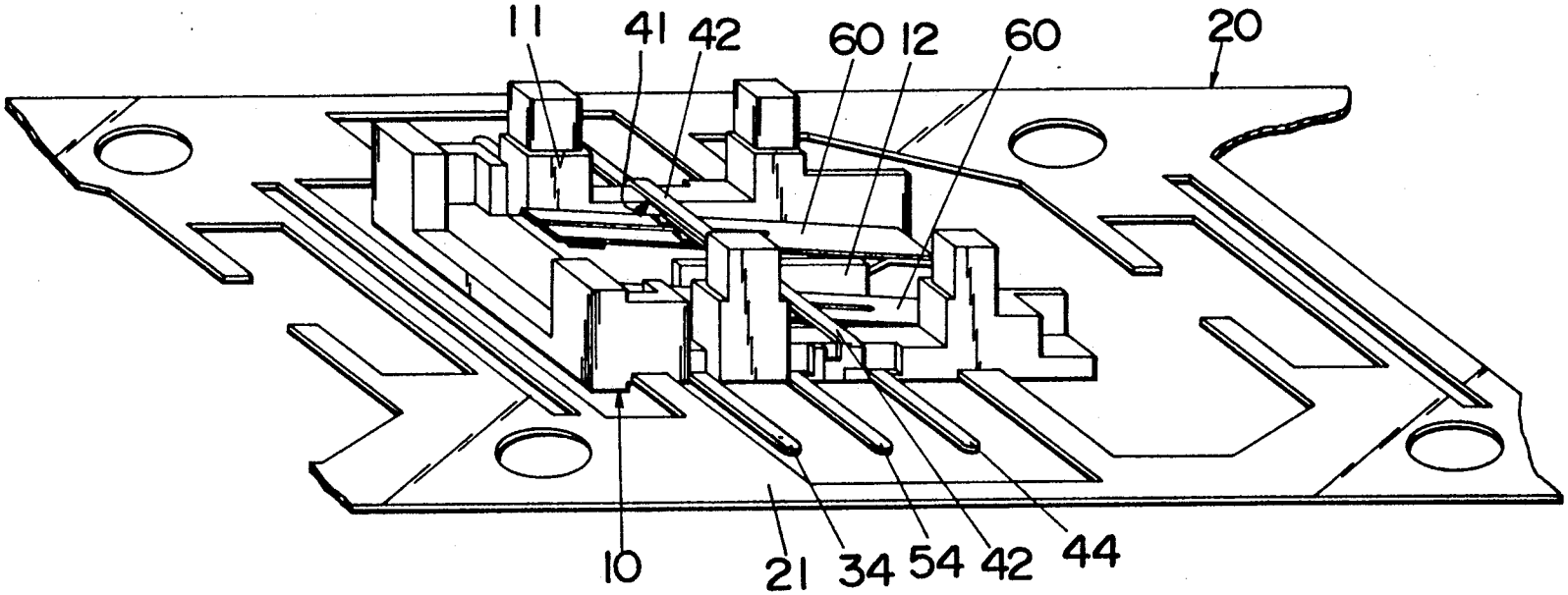
FIG. 6 is a perspective view illustrating the contact assembly partly formed from a metal sheet and partly molded into the base in a process of fabricating the contact assembly.
Figure 7:
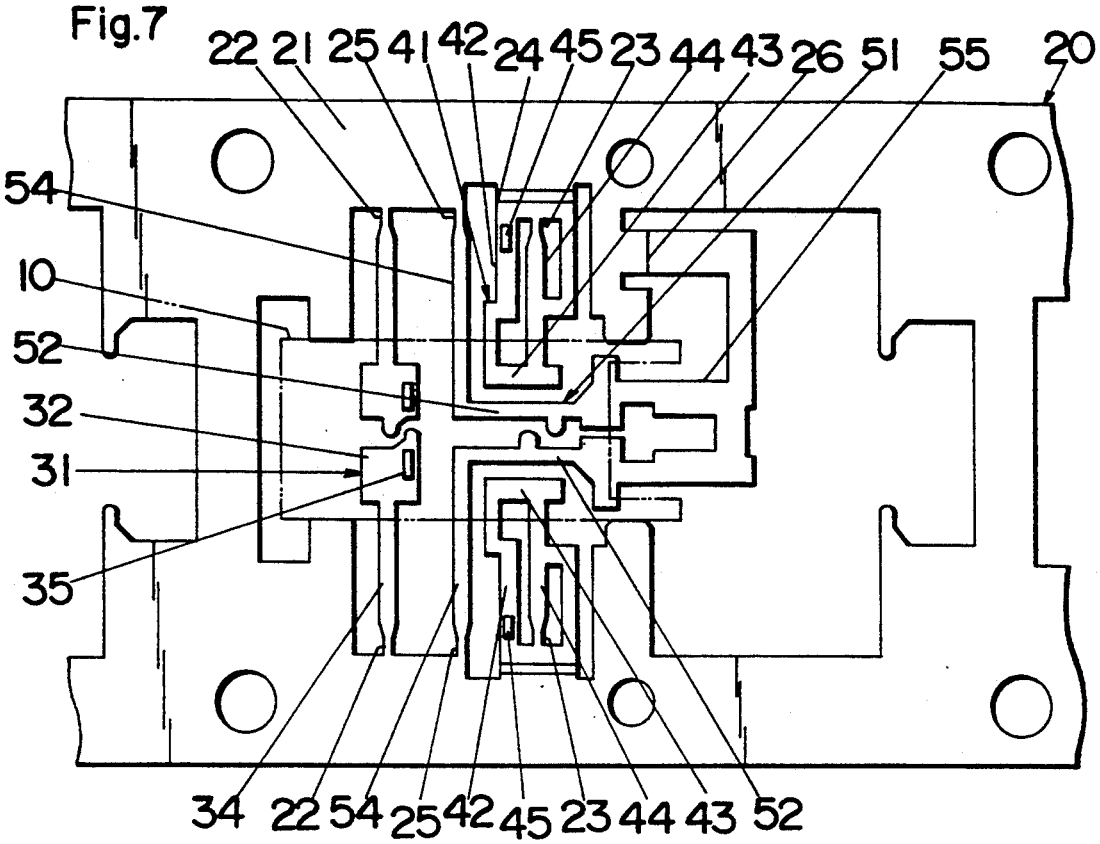
FIGS. 7 and 8 are plan views respectively illustrating the forming of the contact assembly together with the base on the metal sheet.
Figure 8:
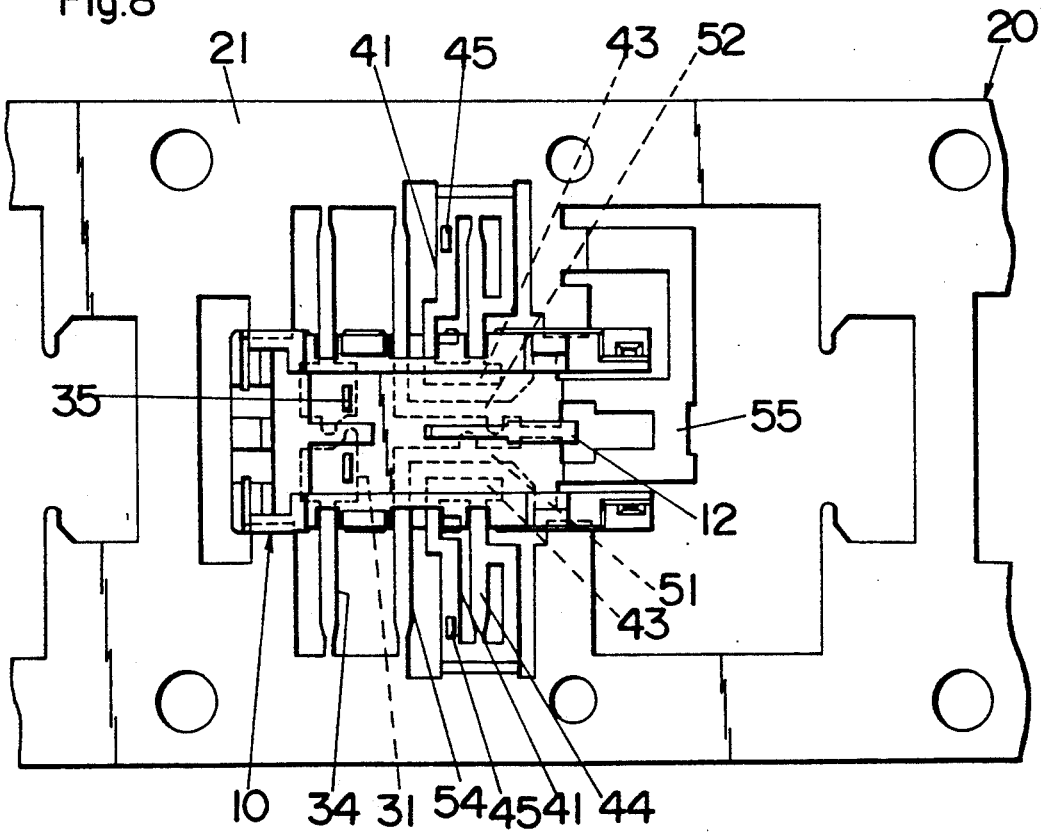
Figure 9A:
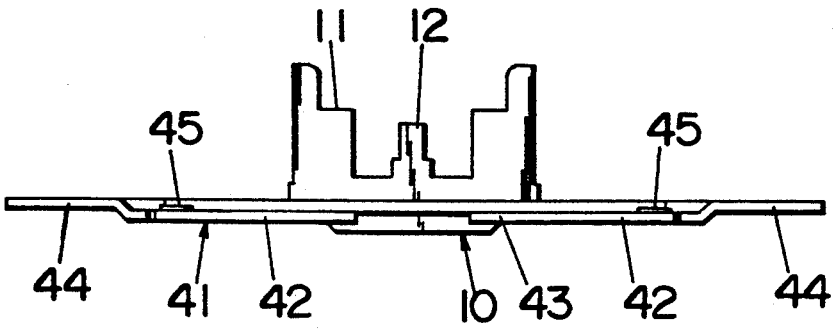
FIGS. 9A to 9C illustrate the formation of a NC fixed contact of the contact assembly.
Figure 9B:
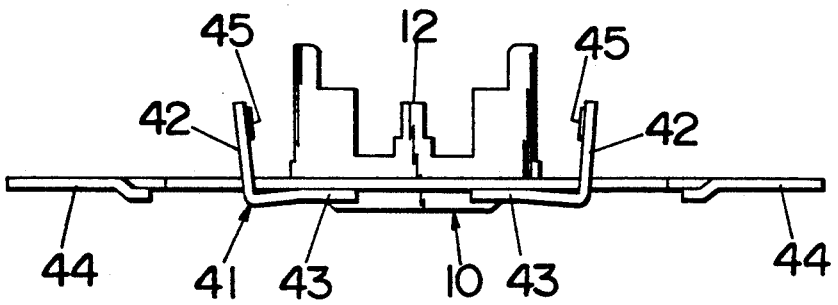
Figure 9C:
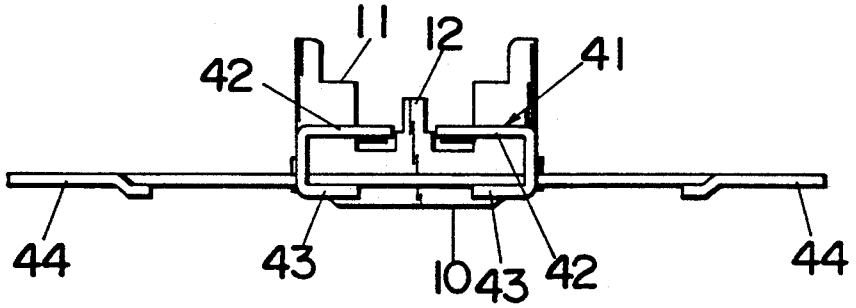

FIG. 6 illustrates the base 10 as molded on a metal sheet or tape 20 which is formed with the NO contacts 31, the NC contacts 41, and the common conductors 51 as being struck therefrom. As shown in FIG. 7, the metal tape 20 is configured to have a unit frame 21 within which the components 31, 41 and 51 are formed. The NO contact 31 is composed of a land 35 with a contact tip 32 and the NO terminal lead 34 extending from the land 32 and terminating into the frame 21 at a constriction 22. The NC contact 41 is composed of a contact strip 42 with a contact tip 45 and the NC terminal lead 44 which extends in parallel with the contact strip 42 from an anchor segment 43 and terminates into the frame 21 at a constriction 23, while the contact strip 42 terminates into the frame 21 at 24 adjacent the constriction 23. The common conductor 51 includes a rather elongated land 52 from the opposite ends which the common terminal lead 54 and a reinforcing segment 55 extend and terminate into the frame 21, respectively at 25 and 26. The base 10 is molded over a portion of the frame 21 as indicated by the dotted line in FIG. 7 such that the NO contact 31 has its land 32 molded in the upper surface of the resulting base 10 together with an adjacent portion of the NO terminal lead 34, the NC contact 41 has its anchor segment 43 molded in the base 10 together with the adjacent portions of the NC terminal lead 44 and the contact strip 42, and the common conductors 51 has its land 52 molded in the surface of the base 10 together with the adjacent portion of the common terminal lead 54. Since the land 32 of the NO contact 31, the land 52 of the common conductor 51, and the anchor segment 43 of the NC contact 41 are molded into the base 10, the molded-in portion of the components can effectively reinforce the base 10 to give enough strength to the base 10, which in turn makes it possible to reduce the thickness of the base 10 while retaining enough desired strength to mount the contact assemblies 30 and the electromagnet block 70. After the base 10 is molded as shown in FIG. 8, another tape (not shown) formed with the movable springs 60 is fed over the base 10 to place the movable springs 60 on the common conductors 51. Then, the movable spring 60 is welded at its one end to one end of the elongated land 52 of the common conductor 51. Thereafter, the contact strip 42 of the NC contact 41 is cut off from the frame 21 at 24 followed by being bent upwardly and then inwardly, through the steps of FIG. 9A to 9C, in such a manner as to extend over the movable spring 60 with the contact tip 45 into engagement with the second contact 62 on the movable spring 60, as shown in FIGS. 5 and 6, thereby completing the contact assemblies 30 on the base 10. Finally, the contact assemblies 30 are detached, together with the base 10, from the frame 21 at the ends of the corresponding terminal leads 34, 44, and 54 with the common conductors 51 being separated from the reinforcing segment 55.

The terminal leads 34, 44, 54 projecting from the base 10 are bent downwardly in a predetermined spaced relation. The contact assemblies 30 thus formed together with the base 10 as a unitary structure is then assembled with the electromagnet block 70 such that the coil terminal leads 80 penetrates through corresponding holes 15 in the longitudinal end of the base 10. A plastic cover 90 is fitted over the electromagnet block 70 and the contact assemblies 30 to the base 10 to hermetically seal the interior of the case 90.

Figure 10:
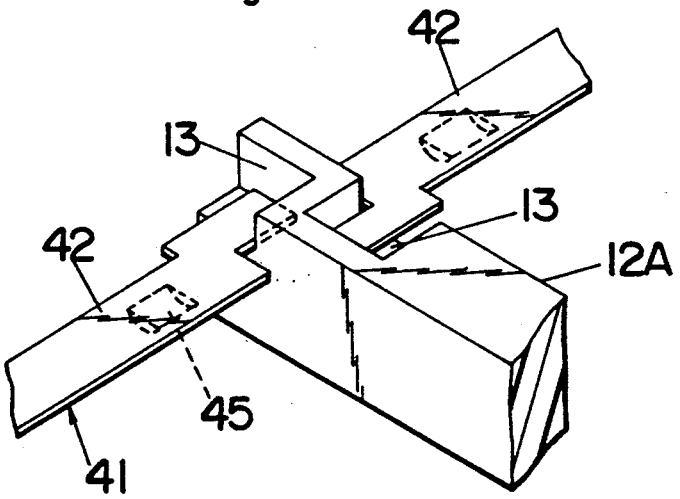
FIG. 10 is a perspective view of a modified structure of the base.

FIG. 10 illustrates a modification of the above embodiment in which the separator rib 12A is formed with a longitudinally staggered pair of notches 13 which engages with the free ends of the NC contacts 41A, i.e., the contact strips thereof, whereby fixing the NC contacts 41A in place to establish exact spacial relation to the second contacts of the movable springs for reliable contacting operation.

What is claimed is:

1. A miniature transfer relay comprising:

a molded base carrying a contact assembly which includes a normally-open (NO) fixed contact, a normally-closed (NC) fixed contact, a common conductor, and a movable spring extending from said common conductor and carrying first and second movable contacts disposed in contacting relation respectively with said NO and NC fixed contacts;

an electromagnet block supported on said base over said contact assembly and including coil means and an armature which is movable between set and reset positions upon energization and de-energization of said coil means, said armature being operatively associated with said movable spring for simultaneously closing and opening said NO and NC contacts in response to movement of the armature between said set and reset positions;

said NO fixed contact molded in an upper surface of said base and having an NO terminal lead projecting from said base;

said NC fixed contacts having a portion molded in said base and having an NC terminal lead projecting from said base;

said NC fixed contacts having a portion molded in said base and having an NC terminal leads projecting from said base;

said common conductor molded in the upper surface of said base and having a common terminal lead projecting from said base;

said movable spring comprising an elongated self-biased resilient member which is formed at one longitudinal end thereof with said first movable contact, and which is secured at the other longitudinal end to said common conductor such that said movable spring can resiliently flex in a cantilever fashion to move said first movable contact into and out of contact with said NO fixed contact;

said movable spring carrying said second movable contact at a portion intermediate its longitudinal ends and on a surface opposite of said first movable contact; and said NC fixed contact extending upwardly from said base and being bent over said movable spring to be kept in normally closed relation to said second movable contact;

said NO contact, said NC contact, said common conductor, said NO terminal, said NC terminal, and said common terminal having respective portions molded into a bottom wall of said base, and said NC contact having a generally U-shaped configuration, wherein a first end of said NC contact is integrally connected to said bottom wall of said base, and an intermediate portion of said NC contact is bent such that a second end of said NC contact is disposed above said movable spring.

2. A miniature transfer relay as set forth in claim 1, wherein said NO fixed contact, NC fixed contact, and said common conductor are punched out together with the associated terminal leads from a single metal sheet.

3. A miniature transfer relay as set forth in claim 1, further including an additional contact assembly which comprises a set of NO and NC fixed contacts, a common conductor, and a movable spring extending from said common conductor and carrying first and second movable contacts, said additional contact assembly being disposed in a parallel relation to said contact assembly; and said base formed with a separator rib which projects on said base between said movable springs of said two contact assemblies.

4. A miniature transfer relay as set forth in claim 3, wherein said separator rib is formed with a pair of notches in opposite sides thereof into which free ends of said NC fixed contacts of said two contact assemblies are fitted, respectively.

5. A miniature transfer relay as set forth in claim 3, wherein said separator rib supports said electromagnet block.

6. A miniature transfer relay as set forth in claim 1, wherein said NC contact is bent along an exterior of the base into said U-shaped configuration.

7. A method of assembling a relay comprising a molded base carrying a contact assembly which includes a normally-open (NO) fixed contact, a normally-closed (NC) fixed contact, a common conductor, and a movable spring extending from said common conductor and carrying first and second movable contacts disposed in contacting relation respectively with said NO and NC fixed contacts; an electromagnet block supported on said base over said contact assembly and including coil means and an armature which is movable between set and reset positions upon energization and de-energization of said coil means, said armature being operatively associated with said movable spring for simultaneously closing and opening said NO and NC contacts in response to movement of the armature between said set and reset positions; said NO fixed contact molded in an upper surface of said base and having an NO terminal lead projecting from said base; said NC fixed contacts having a portion molded in said base and having an NC terminal leads projecting from said base; said common conductor molded in the upper surface of said base and having a common terminal lead projecting from said base; said common conductor molded in the upper surface of said base and having a common terminal lead projecting from said base, said movable spring comprising an elongated self-biased resilient member which is formed at one longitudinal end thereof with said first movable contact, and which is secured at the other longitudinal end to said common conductor such that said movable spring can resiliently flex in a cantilever fashion to move said first movable contact into and out of contact with said NO fixed contact; said movable spring carrying said second movable contact at a portion intermediate its longitudinal ends and on a surface opposite of said first movable contact; and said NC fixed contact extending upwardly from said base and being bent over said movable spring to be kept in normally closed relation to said second movable contact; said NO contact, said NC contact, said common conductor, said NO terminal, said NC terminal, and said common terminal having respective portions molded into a bottom wall of said base, said NC contact having a generally U-shaped configuration, wherein a first end of said NC contact is integrally connected to said bottom wall of said base, an intermediate portion of said NC contact is bent such that a second end of said NC contact is disposed above said movable spring;

said method comprising the steps of:

(a) preparing a metal sheet comprising (i) said NO contact, (ii) said NO terminal contiguously extending from said NO contact, (iii) said NC contact, (iv) said NC terminal contiguously extending from said NC contact through an anchor segment, (v) said common conductor, and (vi) said common terminal contiguously extending from said common conductor, all arranged substantially in a common plane;

(b) molding (i) a portion of said NO contact, (ii) said anchor segment, and (iii) a portion of said common conductor into the bottom wall of said base;

(c) bending said intermediate portion of said NC contact into the U-shaped configuration outwardly of said base so as to have said second end portion thereof disposed above said movable spring; and (d) detaching said NO terminal, said common terminal, and said NC terminal from said metal sheet.

8. A method as set forth in claim 7, wherein said movable spring is welded to said common conductor after said base is formed by molding, and said NC contact is bent into the U-shaped configuration subsequent thereto.

9. A method as set forth in claim 8, wherein said NC contact is bent such that said intermediate portion between said second end of said NC contact and said anchor element is in contact with the exterior of said base.

10. A method as set forth in claim 8, wherein said common conductor has an end portion projecting outwardly of said base, said end portion being welded to said movable spring.

11. A method as set forth in claim 7, wherein said common conductor extends contiguously from said metal sheet through a reinforcing segment which is connected to said metal sheet outwardly of said base and away from said common terminal, said common conductor being detached from said reinforcing segment after said base is formed.

* * * * *